US005881022A

United States Patent [19]

Morganstein

[11] Patent Number: 5,881,022

[45] Date of Patent: Mar. 9, 1999

[54] FREQUENCY SHIFING DEVICE AND METHOD FOR AUTOMATIC CLOCK ADJUSTMENT

[75] Inventor: Sanford J. Morganstein, West Dundee, Ill.

[73] Assignee: Illinois Information Technology Corporation, West Dundee, Ill.

[21] Appl. No.: 585,374

[22] Filed: Jan. 11, 1996

[51] Int. Cl.[6] ..... G04C 11/00

[52] U.S. Cl. ..... 368/46; 368/51; 368/200

[58] Field of Search ..... 368/46–51, 186, 368/187, 200

[56] References Cited

U.S. PATENT DOCUMENTS

| | | | |
|---|---|---|---|
| 3,675,410 | 7/1972 | Blackwell | 368/61 |
| 3,685,278 | 8/1972 | Haydon | 368/48 |
| 3,690,059 | 9/1972 | Haydon | 368/48 |
| 4,040,247 | 8/1977 | Haydon | 368/156 |
| 4,490,050 | 12/1984 | Singhi | 368/46 |
| 4,582,434 | 4/1986 | Plangger et al. | 368/46 |
| 4,768,178 | 8/1988 | Conklin et al. | 368/47 |
| 4,956,826 | 9/1990 | Coyman et al. | 368/28 |
| 4,993,003 | 2/1991 | Fechner et al. | 368/47 |
| 5,251,191 | 10/1993 | Sturzl et al. | 368/47 |
| 5,282,180 | 1/1994 | Burke et al. | 368/46 |
| 5,319,374 | 6/1994 | Desai et al. | 342/387 |
| 5,334,975 | 8/1994 | Wachob et al. | 340/825 |
| 5,363,348 | 11/1994 | Damle | 368/47 |
| 5,375,018 | 12/1994 | Klausner | 368/47 |
| 5,425,004 | 6/1995 | Staffan | 368/46 |
| 5,442,335 | 8/1995 | Cantin et al. | 340/825 |
| 5,442,599 | 8/1995 | Burke | 368/46 |
| 5,452,344 | 9/1995 | Larson | 379/107 |

*Primary Examiner*—Bernard Roskoski
*Attorney, Agent, or Firm*—Baker & Botts, L.L.P.

[57] ABSTRACT

A device (10) for automatically adjusting a device containing a clock (70) that derives its timing function from the frequency of an alternating current signal on a power line is provided. The device (10) includes a controller (15) that receives user-entered controls for adjusting the clock (70) and generates control signals in response to the user-entered controls. The device also includes a frequency changer (11) that responds to the control signals to increase or decrease the frequency of the alternating current signal applied to the clock (70) so that the clock (70) may be adjusted.

18 Claims, 5 Drawing Sheets

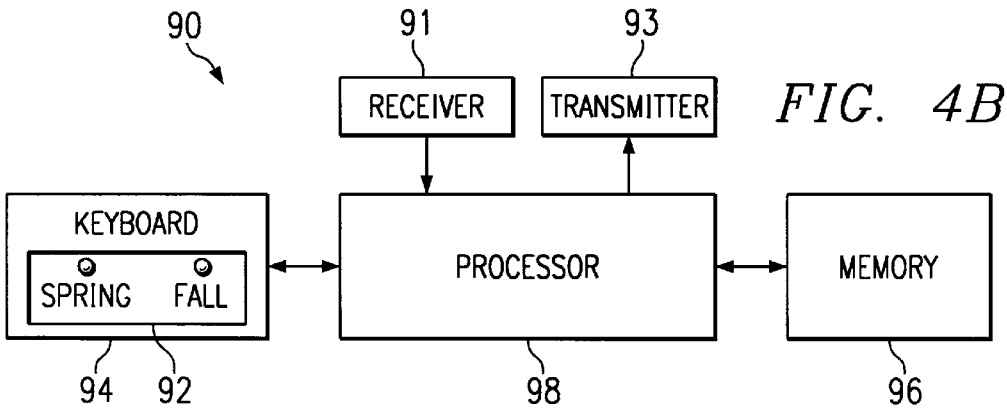
FIG. 4B
FIG. 5A
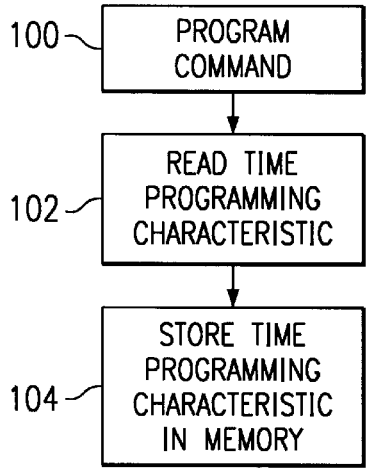
FIG. 5B
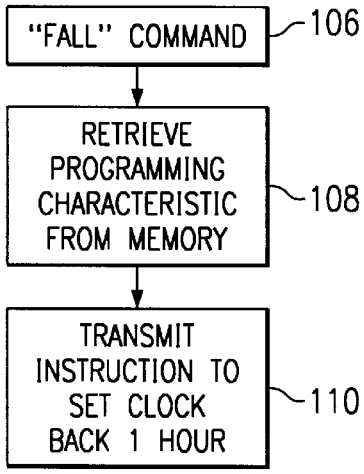
FIG. 5C
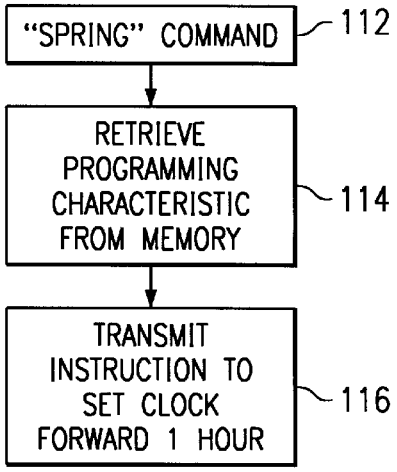

FREQUENCY SHIFING DEVICE AND METHOD FOR AUTOMATIC CLOCK ADJUSTMENT

TECHNICAL FIELD OF THE INVENTION

This invention relates in general to the field of clock adjustment devices, and more particularly to a power line frequency adjusting device and method for automatic clock adjustment.

BACKGROUND OF THE INVENTION

In the field of clock adjustment devices, there have been many previously-developed devices for facilitating clock adjustment. Many of these devices are for applications having a large number of clocks, such as a school or office building. For example, one system for resetting a large number of clocks involves the use of an additional stepper motor installed in each clock. When the stepper motor receives appropriate signals over a power line, it operates to cause the clock to read a certain time. The signals sent over the power line are at a frequency different from the rated alternating current (AC) power line frequency. Additional signals are then used to cause the stepper motor to set the clock to the correct time. If a clock does not contain the stepper motor, it cannot be reset by this system.

Another method that has been used to set clocks uses a high-frequency signal that is transmitted over the AC power line to the clock. The high-frequency signal is different from the AC power line frequency. The clock contains a control device that receives the high-frequency signal and controls the clock motor such that the clock may be reset to a new time. In order for the clock to be responsive to the control signal it must contain the control device.

Each of these and other previously developed methods and systems for controlling clocks suffer from the same problem; that is, in order for the method to work with a given clock, a special device or control must be installed in the clock.

SUMMARY OF THE INVENTION

Therefore a need has arisen for an automatic clock adjusting device and method that eliminates the problems associated with previously developed automatic clock adjusting devices and methods. The present invention provides a clock adjusting device that allows for an automatic change in a clock without requiring additional control devices to be installed in the clock.

One aspect of the present invention provides a device for automatically adjusting a device containing a clock that derives its timing function from the frequency of an alternating current signal on a power line. The device includes a controller for receiving user-entered controls for adjusting the clock. The controller generates control signals in response to the user-entered controls, and a frequency changer responds to the control signals to shift the frequency of the alternating current power signal applied to the clock so that the clock may be adjusted.

Another aspect of the present invention provides a remote controller for controlling a device having a clock. The remote controller includes input keys for effectuating input commands. At least one of the input commands causes the clock in the device to be advanced or set-back a predetermined amount.

Another aspect of the present invention provides a device for automatically adjusting a device containing a clock that derives its timing function from the frequency of an alternating current signal on a power line. The device includes a controller for receiving user-entered controls for adjusting the clock. The controller generates control signals in response to the user-entered controls. The controller further includes a function for causing a clock to advance and retreat a predetermined time period.

The device also includes a frequency changer coupled to the controller that responds to the control signals and the frequency changer increases or decreases the frequency of the alternating current signal applied to the clock. The frequency changer further includes an AC-to-DC converter for receiving an alternating current power signal and providing a direct current power signal. The frequency changer also includes a low-pass filter coupled to the AC-to-DC converter that removes any remaining high-frequency power signal components from the direct current power signal. A timing circuit is also provided in the frequency changer that receives the control signals from the controller and outputs a timing signal in response to the control signals. A DC-to-AC converter in the frequency changer couples to the timing circuit and converts the direct current power signal from the AC-to-DC converter to an alternating current power signal in response to the timing signal from the timing circuit.

Yet another aspect of the present invention includes a method for automatically adjusting a clock that derives its timing function from the frequency of an alternating current signal on a power line. The method includes the steps of shifting the frequency of the alternating current signal to cause the clock to run at a modified speed over the time period of the adjustment. The method also includes returning the frequency of the applied alternating current signal to its rated frequency after the clock adjustment is completed.

Yet another aspect of the present invention is a method for remotely controlling a device containing a clock. The method includes the step of transmitting a single command to cause the clock to either advance or be set back a predetermined amount.

The present invention provides several technical advantages. One important technical advantage of the present invention is that a clock that derives a timing signal from the frequency of a power line can be adjusted with the present invention without requiring the installation of additional equipment in the clock.

Another important technical advantage of the present invention is that it may be operated by remote control, enabling the device to be used with clocks located in hard-to-reach or inaccessible places.

An additional technical advantage of the present invention is that it is compatible with other remote controlled devices, such that a single remote control can be used to adjust all clocks.

Yet another technical advantage of the present invention is that it can be used to simultaneously adjust every clock in a building.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 4B provides a schematic diagram for an exemplary programmable remote controller of FIG. 4A; and FIGS. 5A, SB, and 5C show logic diagrams useful in describing the functioning of a programmable remote controller of the present invention.

DETAILED DESCRIPTION OF THE INVENTION

Preferred embodiments of the present invention are illustrated in the FIGURES, like numerals being used to refer to like and corresponding parts of the various drawings.

Figure 1:
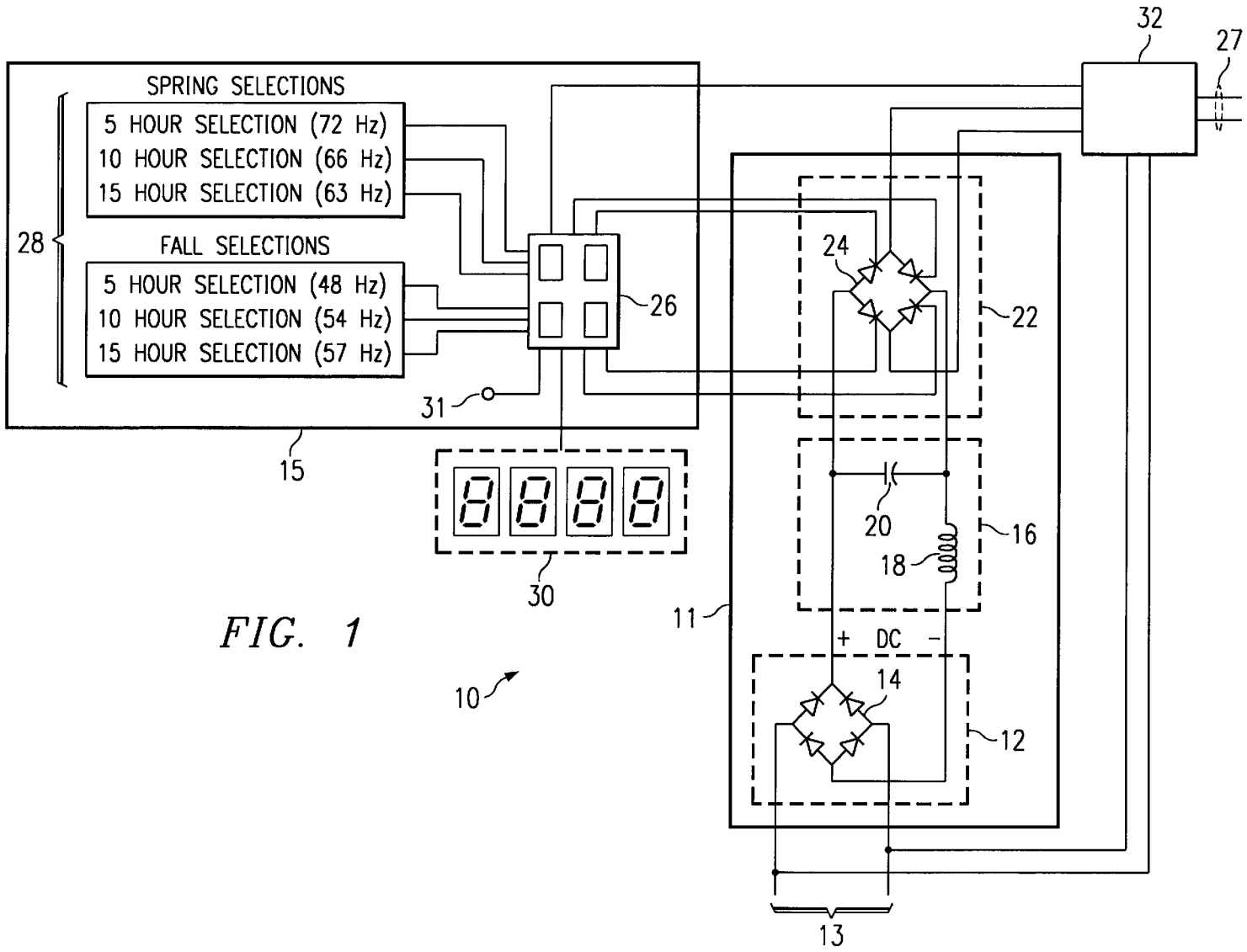
FIG. 1 illustrates an exemplary block diagram of the device for automatic clock adjustment of the present invention.

FIG. 1 illustrates an exemplary block diagram of device 10 for automatic clock adjustment in accordance with the present invention. Device 10 includes controller 15 and frequency changer 11. In operation, device 10 converts AC power at a rated frequency to AC power at a controllable frequency. Any clock that receives a timing function from the AC power frequency can be controlled to run at a different speed by adjusting the frequency of the AC power to the clock. Therefore, when device 10 is in operation, any clocks coupled to it will run at a slower or faster speed, depending upon the control settings chosen for device 10. Device 10 can be used to both advance and set back the time registered by a clock.

For example, if device 10 is to advance the setting of a clock that normally runs at 60 Hz, the frequency of the signal provided by device 10 will be greater than 60 Hz. By providing the increased frequency signal to the clock over a period of time the time setting of the clock may be increased by the desired amount. The amount of time required to advance the clock the desired amount is a function of the frequency of the signal provided to the clock. Therefore, if one desires to change the setting of the clock over a short period of time, then a higher frequency control signal is used, as opposed to when a longer period of time is available to set the clock. Care must be taken not to shift the frequency too much. Protective circuitry (not explicitly shown) may be added to controller 15 to prevent damage to controlled devices.

The invention is also functional to set-back the time on a clock. If the frequency of the signal provided to the clock is decreased below its normal rate, e.g., 60 Hz, the clock will run slower than normal. The time necessary to set-back a clock with the present invention is also a function of the change in frequency of the signal to the clock. In this way, device 10 of the present invention may be used to advance or set-back the time registered by a clock without requiring additional devices or circuitry in the clock.

Device 10 may also indicate when it is in operation and may display the amount of time left before a time shifting operation is completed. Device 10 runs for an appropriate period of time at a higher or lower frequency such that any clock coupled to it will modify its time setting by an appropriate amount.

Device 10 in FIG. 1 includes frequency changer 11 that includes converter 12, filter 16, and converter 22. Converter 12 converts an AC signal from AC input 13 to a DC signal. Converter 12 couples to filter 16 that filters high-frequency components from the DC signal provided by converter 12. Filter 16 couples to DC-to-AC converter 22 that converts the DC signal to AC signal output 27 at the desired frequency. Converter 22 and converter 12 couple to switch 32 that provides a bypass through device 10 when device 10 is not in operation. Those skilled in the art will appreciate that other frequency-shifting circuits and devices may be used for frequency changer 11 without departing from the scope and intent of the present invention.

For exemplary purposes, converter 12 as shown in FIG. 1 is an AC-to-DC rectifier including diodes 14 that are connected to function as a half-wave rectifier. Those skilled in the art will recognize that converter 12 may be many conventional AC-to-DC rectification circuits without departing from the scope or spirit of the present invention. Converter 12 accepts an AC signal and converts it to a predominantly DC signal. It is noted that some minor high-frequency components may exist in the signal provided by converter 12.

For exemplary purposes, filter 16 as shown in FIG. 1 is a low-pass filter including inductor 18 and capacitor 20. Typically, filter 16 has an operating frequency pass range below 100 Hz. Those skilled in the art will recognize that filter 16 may be many conventional low-pass filters without departing from the scope or spirit of the present invention. Filter 16 removes any high-frequency components from the DC signal from converter 12 that may have an adverse affect on the operation of converter 22.

For exemplary purposes, converter 22 as shown in FIG. 1 is a DC-to-AC inverter including silicon controlled rectifiers (SCRs) 24. SCRs 24 are coupled to timing circuit 26 and generate an AC signal having a desired frequency in response to signals from timing circuit 26. Those skilled in the art will recognize that converter 22 may be many conventional circuits that convert DC power to AC power at a controllable frequency without departing from the spirit or scope of the present invention. Converter 22 converts a DC signal to an AC signal at a controllable frequency and accepts frequency control signals from timing circuit 26.

As previously noted, timing circuit 26 of controller 15 is coupled to converter 22. Timing circuit 26 provides control signals to SCRs 24 in converter 22 so that converter 22 generates an AC signal having the desired frequency from the DC signal it receives from converter 12 and filter 16. Timing circuit 26 also outputs a signal to display 30 in device 10. Display 30 indicates the amount of time remaining until device 10 completes a given time shifting operation. Device 10 also includes control inputs 28 to timing circuit 26 that are determined from user actuation of control mechanisms (not explicitly shown). Any appropriate control mechanisms can be used, including but not limited to buttons, switches, keypads, digital interfaces, and potentiometers.

Control inputs 28 shown in FIG. 1 illustrate examples of signals that may be used to set a clock or clocks forward or back in accordance with daylight savings time. In the box labeled "Spring Selections" are shown the parameters for three signals for advancing a clock one hour, i.e., "spring ahead." The exemplary options for the control signals to advance a clock one hour include generating a 72 Hz signal (as compared to a normal 60 Hz signal) for a time-shift operation that would occur over five hours; a 66 Hz signal for an operation lasting 10 hours; and a 64 Hz signal for an operation lasting 15 hours. In the box labeled "Fall Selections" are shown the parameters for three signals for setting-back a clock one hour, i.e., "fall back." The parameters for the fall signals include generating a 48 Hz signal for a time-shifting operation lasting five hours; a 54 Hz signal for an operation lasting ten hours; and a 56 Hz signal for an operation lasting 15 hours to set-back a clock the necessary one hour. While these specific examples for control signals 28 are shown in FIG. 1, it is understood that other parameters for achieving the desired hour shift for day light savings time, as well as other time shifting operations, e.g., to correct for a temporary loss of power, may be used without deviating from the scope and intent of the present invention.

Timing circuit 26 also outputs a signal to switch 32 in device 10 that causes switch 32 to change states. This occurs once when the time-shifting operation begins, and again when timing circuit 26 has determined that a sufficient amount of time has elapsed for completion of the time shifting operation. Timing circuit 26 then causes switch 32 to change states so that the bypass loop through device 10 is established. Those skilled in the art will appreciate that other timing circuits and switches may be used without departing from the spirit or scope of the present invention.

Device 10 in FIG. 1 also includes detector 31 that detects a signal from a remote controller (not explicitly shown) for controlling device 10. Detector 31 allows device 10 to be operated remotely from a convenient location. Detector 31 may be suitable for use with infrared or radio signals.

Figure 2A:
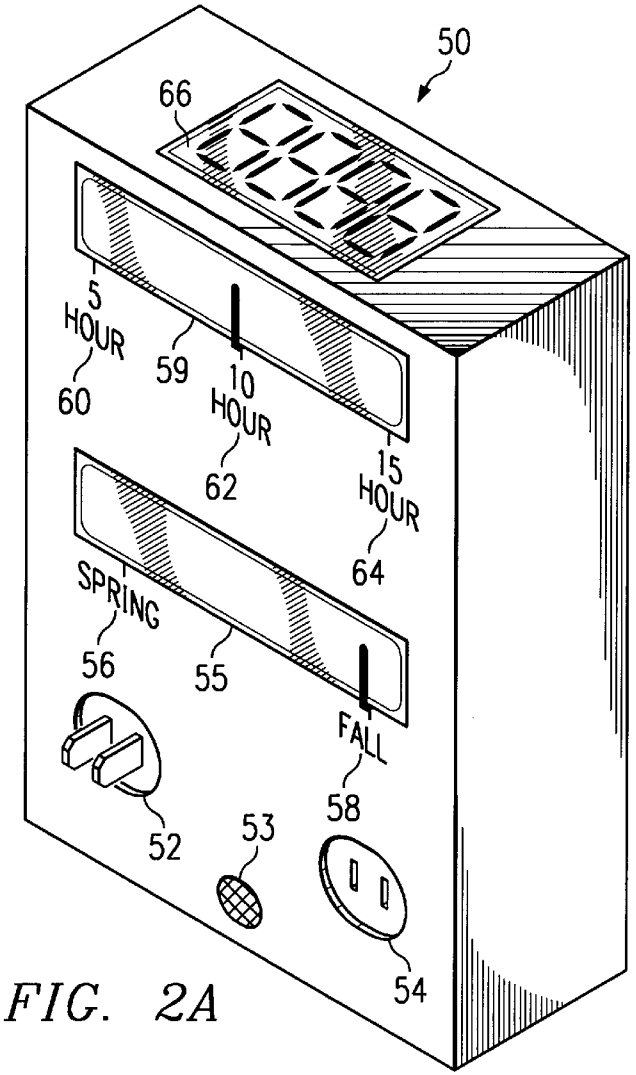
FIGS. 2A and 2B show a clock terminal controller embodiment of the present invention, standing alone and in use, respectively.

FIG. 2A shows an embodiment of clock terminal controller 50 of the present invention. Device 10 of FIG. 1 is contained within clock terminal controller 50 that also includes AC input 52 (corresponding to AC input 13 in FIG. 1) and AC output 54 (corresponding to AC output 27 in FIG. 1). AC input 52 may include conductors and a plug (not explicitly shown) to allow clock terminal controller 50 to be powered from a conventional wall outlet. AC output 54 may include a conventional AC plug socket.

Clock terminal controller 50 may also include switch 55, one embodiment of which is a two position slide switch for implementing the time adjustments associated with daylight saving time as previously described in discussions relating to FIG. 1. In this embodiment, switch 55 includes settings for "Spring" control 56 and "Fall" control 58.

Clock terminal controller 50 may also include switch 59 for setting the duration for a clock adjustment. As shown in the exemplary embodiment in FIG. 2A, switch 59 may be a three-position switch having settings for 5-hour control 60, 10-hour control 62, and 15-hour control 64. As previously discussed in discussions relating to FIG. 1, these hour parameters correspond to the amount of time for a given clock adjustment. Those skilled in the art will appreciate that other switches and settings may be used in addition to those shown in FIG. 2A without departing from the spirit or scope of the present invention.

As shown in FIG. 2A, clock terminal controller 50 may also include display 66 that corresponds to display 30 in FIG. 1. Display 66 may include a digital readout display or a plurality of colors, as needed, in order to accurately and clearly convey that clock terminal controller 50 is in operation. Display 66 may also be omitted. The readout and colors may be implemented in light-emitting diodes (LEDs), a liquid crystal display (LCD), and many other suitable display mechanisms.

Clock terminal controller 50 in FIG. 2A also includes detector 53, which corresponds to detector 31 in FIG. 1. Detector 53 may detect appropriate command signals from a remote controller (not explicitly shown) for controlling the operation of device 10. In an alternate embodiment of clock terminal controller 50, it may be designed to operate entirely from remote control commands received by detector 53, such that switches 55 and 59 are not required. Alternately, detector 53 may be an electromechanical switch for activating clock terminal controller 50 and eliminating the need for a remote controller. Also, clock terminal controller 50 may be provided with both an electromechanical switch and detector 53 for use with a remote controller.

Figure 2B:
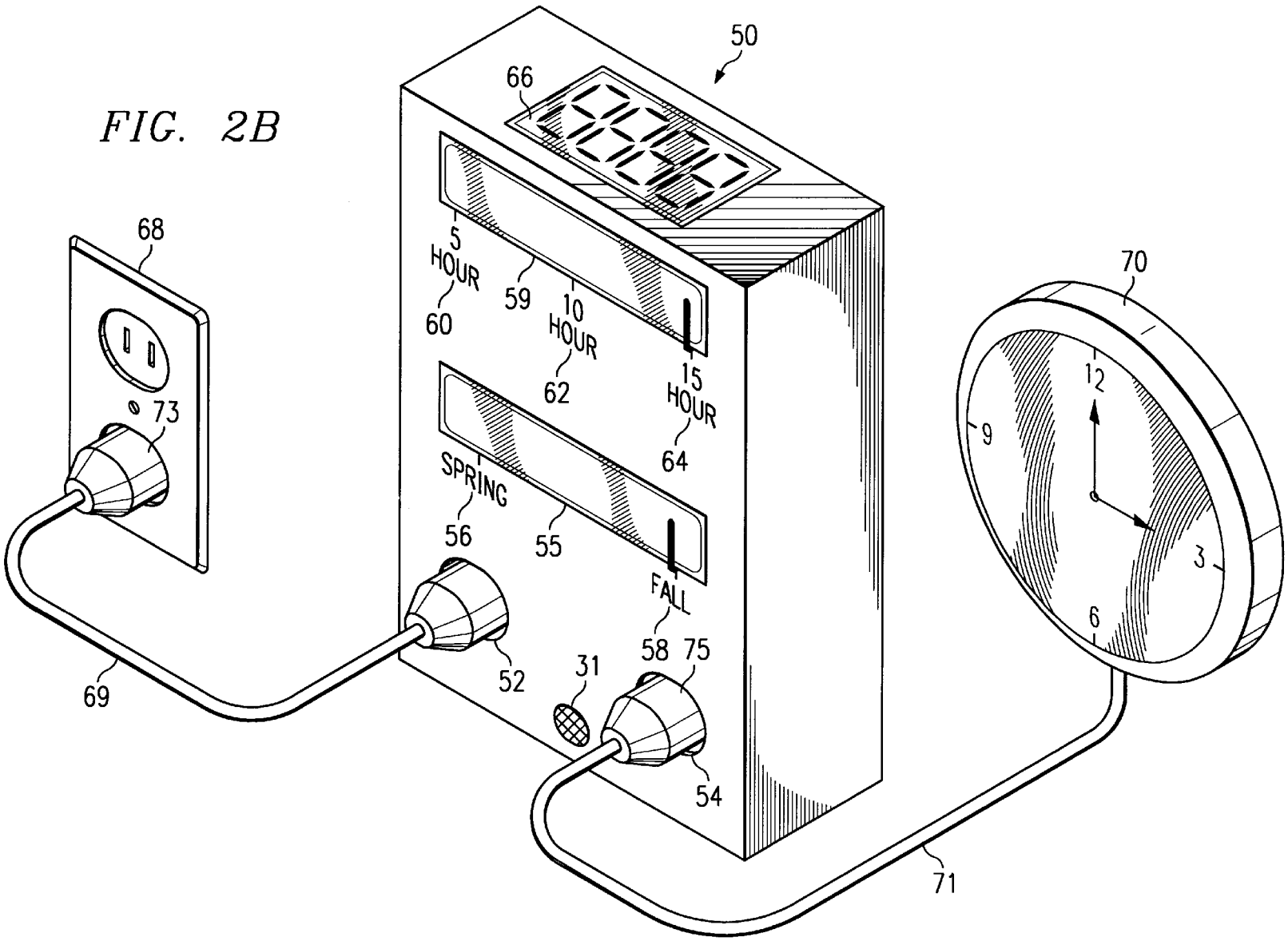

FIG. 2B shows clock terminal controller 50 in operation with clock 70 to change the time setting of clock 70. Clock terminal controller 50 is coupled between AC wall socket 68 and clock 70. In this embodiment, clock terminal controller 50 includes conductor 69 having conventional AC wall socket plug 73. As shown in the embodiment in FIG. 2B, conductor 69 is a conventional 2-conductor power cord. Conductor 69 and plug 73 are coupled to wall socket 68 to provide AC power to clock terminal controller 50.

Clock 70 is a conventional AC powered wall clock that includes conductor 71 and conventional AC wall socket plug 75 that would otherwise be used with wall socket 68. In addition, clock 70 is the type of clock that derives a timing function from the frequency of the signal provided to it, such that clock 70 runs at the desired speed when the frequency of the signal provided to it is at the rated or normal frequency. Clock 70 is coupled to clock terminal controller 50 at AC output 54.

In operation, clock terminal controller 50 receives an AC signal from wall socket 68, and provides the AC signal at its normal frequency, e.g., 60 Hz, to clock 70, using the bypass path provided by switch 32 in device 10 previously described. Presumably, clock 70 is initially set to the correct time and continues to operate undisturbed until a time shift is required. An example of a time shift would be when daylight savings time either begins or ends. When daylight savings time begins or ends, the user activates "Spring" control 56 or "Fall" control 58, respectively, and also activates 5-hour control 60, 10-hour control 62, or 15-hour control 64 depending on the amount of time available for time shifting and the allowable frequency range of the clock. After the two appropriate controls have been activated, the user activates switch 32 in device 10 by transmitting a signal to detector 31 from a programmable remote controller (not explicitly shown), causing device 10 to initiate the appropriate time shifting process as previously described in discussions relating to FIG. 1.

In order to automatically adjust the time setting of clock 70 after actuation of clock terminal controller 50, converter 22 must output an AC signal having certain set frequencies as previously described. For example, if the power line frequency is normally at 60 Hz and the "Spring" control, i.e., advance clock one hour, and 5-hour controls are chosen, converter 22 must output a signal at 72 Hz for 5 hours. When the five hours have elapsed, timing circuit 26 or its equivalent in converter 22 causes switch 32 to actuate, thus re-establishing the bypass path isolating converter 12 and converter 22. This returns clock terminal controller 50 to its off state so that a signal at the rated frequency, e.g., 60 Hz, is provided to clock 70. During the 5 hour period, display 66 shows the time remaining before the time-shifting operation is completed.

FIGS. 2A and 2B also illustrate other exemplary settings for clock terminal controller 50. For example, assuming the rated frequency of the signal to the clock is 60 Hz, the "Spring" and 10-hour setting results in a 66 Hz signal being provided to a clock, and the "Spring" and 15-hour setting results in a 64 Hz signal being provided to a clock. Likewise, the "Fall" settings for time shifting operations lasting 5-, 10-, and 15-hours result in a signal having a frequency of 48, 54, and 56 Hz, respectively, when the normal frequency is 60 Hz. If the normal frequency is 50 Hz, the "Spring" 5-, 10-, and 15-hour settings would be 60, 55, and 53.3 Hz, respectively, and the "Fall" 5-, 10-, and 15-hour settings would be 40, 45, and 46.6 Hz, respectively.

Other time period settings may be used in addition to 5-, 10-, and 15-hour settings previously described and shown in the FIGURES without departing from the spirit or scope of the present invention. In addition, the amount of time to be shifted may include periods of other than 1 hour. The relationship of the shift frequency, normal or rated frequency, the time period, and the amount of time to be shifted may be represented by the following equation:

$$f_{F-S}=f_R[(\tau_p+X(-1)^K)/\tau_p]$$

where $f_{F-S}$=shift frequency;

$f_R$=rated frequency;

$\tau_p$=time period in hours;

X=amount of time to be shifted in hours; and

K=0 for forward shifting, 1 for reverse shifting

If no settings are chosen, the clock terminal controller will default to a pre-determined setting.

Figure 3:
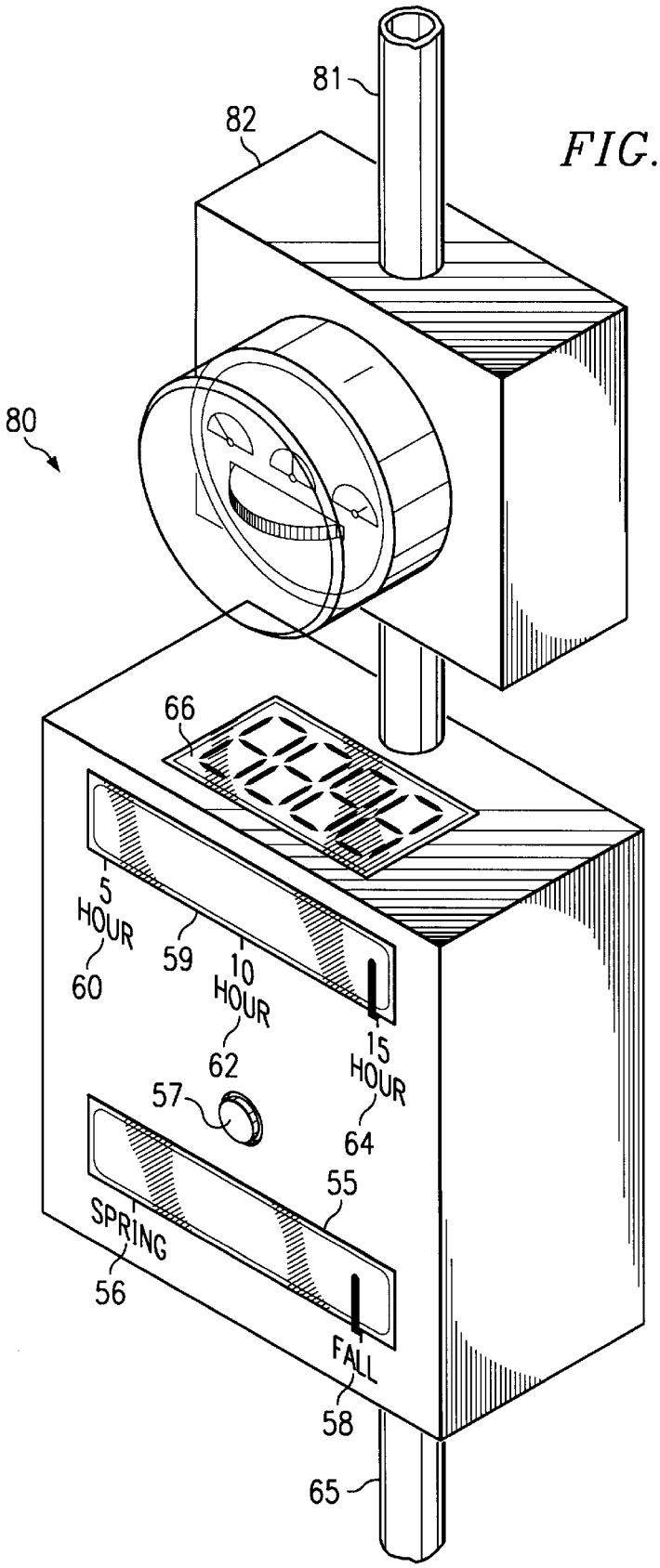
FIG. 3 depicts a power main controller embodiment of the present invention.

FIG. 3 depicts power main controller 80, which is a main power embodiment of the present invention. Power main controller 80 is very similar to clock terminal controller 50 in FIGS. 2A and 2B with the noted exception that power main controller 80 is placed in the main power line that provides an AC signal to the clocks in a structure. Device 10 of FIG. 1 is contained within power main controller 80, which is installed downstream of AC power meter 82. Instead of including an AC input and AC output as in clock terminal controller 50 in FIGS. 2A and 2B, power main controller 80 is directly wired into power main circuit 81 that enters the facility serviced by AC power meter 82. Accordingly, power main controller 80 includes two position slide switch 55 with "Spring" setting 56 and "Fall" setting 58, and three position slide switch 59 with 5-hour setting 60, 10-hour setting 62, and 15-hour setting 64 similar to clock terminal controller 50. Power main controller 80 also includes indicator 66 and start switch 57 similar to clock terminal controller 50.

In operation, power main controller 80 functions in a similar manner as clock terminal controller 50. Upon actuation of one of either the "Spring" setting 56 or "Fall" setting 58, one of either the 5-hour setting 60, the 10-hour setting 62, or the 15-hour setting 64, and reception of a start signal to start switch 57, device 10 in power main controller 80 provides the appropriate signal on AC output 65. Device 10 operates for the period of time determined by the control settings until completion of the time-shifting operation, at which time switch 32 in power main controller 80 changes state and bypasses device 10.

The embodiment of the present invention shown in FIG. 3 provides a technical advantage of being suitable for adjusting the time on several clocks coupled to AC power output 65 at power main controller 80. The frequency shifted signal from power main controller 80 may be used to adjust all the clocks coupled to it. It also eliminates the need for a controller for each clock and provides for a convenient central location for the controller.

Figure 4A:
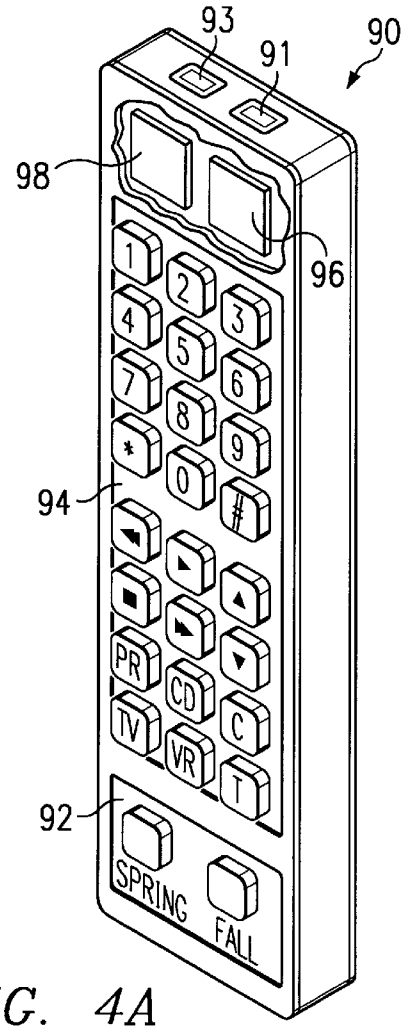
FIG. 4A illustrates an exemplary programmable remote controller of the present invention.

FIGS. 4A and 4B illustrate an exemplary programmable remote controller for use with the present invention. Remote controller 90 may be used in connection with device 10, and in particular, when embodied in clock terminal controller 50 and power main controller 80.

Programmable remote controller 90 includes standard equipment found with known programmable remote controllers. This equipment includes keyboard 94, receiver 91, transmitter 93, memory 96, and processor 98. Keyboard 94 may include user-operable controls for number entry (e.g., numbers 0–9), device entry (e.g., video cassette recorder, television, etc.), and function entry (e.g., fast forward, on, off). In addition, keyboard 94 includes a user-operable control for activating a programming or learning function of processor 98 and user-operable "Spring" and "Fall" controls 92.

Keyboard 94 is coupled to processor 98. Processor 98 may have one of several embodiments, including but not limited to a microprocessor, a general purpose processor, a reduced instruction set computing (RISC) device, or many other analog or digital information processing devices. Processor 98 is coupled to memory 96, receiver 91, and transmitter 93, and is operable to receive user-inputted commands from keyboard 94.

Processor 98 is further operable to receive remote control characteristics from receiver 91 and store the received remote control characteristic in memory 96. Receiver 91 may be, for example, an infrared or radio receiver for receiving signals. For example, a user may input the command "program remote" and upon receiving this command, processor 98 will receive the next remote control characteristic detected by receiver 91 and will store that remote control characteristic in memory 96. Further user-entered controls are used to determine the sequence of controls that will recall that stored remote control characteristic from memory and cause it to be transmitted by transmitter 93.

Processor 98 is further operable to retrieve remote control characteristics from memory 96 in response to user-inputted commands. These remote control characteristics are digital or analog signals that cause a remotely controlled device to operate and their format may be stored in memory 96. For example, a user inputting the commands "video cassette recorder" and "on" of remote controller 90 may want to use it to turn on a video cassette recorder (VCR). Processor 98 would then retrieve from memory 96 the remote control characteristic that will turn on the VCR, and subsequently cause transmitter 93 to transmit the retrieved control characteristic to the VCR. Transmitter 93 may use, for example, infrared or radio signals to transmit the control signals.

When using remote controller 90 with clock terminal controller 50 or power main controller 80, a user's activation of "Spring" and "Fall" controls 92 causes processor 98 to retrieve the appropriate characteristic from memory 96. This characteristic is then transmitted by transmitter 93, detected by start switch 31 or 57, respectively, and recognized by timing circuit 26 of clock terminal controller 50 or power main controller 80 as being the start signal to device 10. Timing circuit 26 may be designed to ignore this signal if it does not correspond to the current setting of switch 55.

FIGS. 5A–5C illustrates exemplary steps for the programming of remote controller 90. Remote controller 90 may be used with a device other than clock terminal controller 50 or power main controller 80 by implementing the steps shown in FIGS. 5A–5C. At step 100 a command is entered from keyboard 94 (not explicitly shown) to cause processor 98 to enter the programming mode. At step 102 processor 98 receives the remote control characteristic detected by receiver 91. This characteristic is provided by another remote controller, e.g., a VCR's remote controller. Such characteristics usually consist of digital or analog data that is emitted as infrared radiation by the remote controller. The user causes the remote controller of the other device to transmit commands for programming the clock of the other device. For example, the user might enter the advance hour command and the subtract hour command. At step 104 processor 98 may store this characteristic in memory 96, or may identify the characteristic from a list of known remote control characteristics that is stored in memory 96 and associate that code with a predetermined sequence of user-entered commands from keyboard 94.

FIG. 5B shows exemplary steps for using remote controller 90 to change the time on a device, including but not limited to clock terminal controller 50 and power main controller 80. At step 106 the user enters the "Fall" command of "Spring" and "Fall" controls 92, and also enters a command that indicates a device to be remotely controlled, e.g., a VCR. Processor 98 retrieves the control characteristic for that device from memory 96 at step 108 and causes transmitter 93 to transmit the control characteristic at step 110.

FIG. 5C, similarly, shows exemplary steps for using remote controller 90 to advance the time on a device, including but not limited to clock terminal controller 50 power main controller 80, and a VCR. At step 112 the user enters the "Spring" command of "Spring" and "Fall" controls 92, and also enters a command that indicates a device to be remotely controlled. Processor 98 retrieves the control characteristic for that device from memory 96 at step 114 and at step 116 causes transmitter 93 to transmit the control characteristic.

Those skilled in the art will recognize that other controls may be used without departing from the spirit or scope of the present invention. Programmable remote controller 90 should be operable to transmit a command to switch 31 or 57 that causes clock terminal controller 50 or power main controller 80 to begin operation. Additionally, controller 90 should be further operable to receive the time control characteristic for other remotely controlled devices and to transmit the appropriate time control instructions for setting the clocks of those devices forward one hour in the spring and back one hour in the fall. Programmable remote controller 90 provides the technical advantage of a device that may be used to set the time of terminal clock controller 50, power main controller 80, and other devices.

One important technical advantage of the present invention is that a clock that derives a timing signal from the frequency of a power line can be adjusted with the present invention without requiring the installation of additional equipment in the clock. In addition, the present invention may be operated by remote control, enabling the device to be used with clocks located in hard-to-reach or inaccessible places. Additional technical advantages of the present invention are that it is compatible with other remote controlled devices, such that a single remote control can be used to adjust all clocks, and that it can be used to simultaneously adjust every clock in a building.

Although the present invention has been described in detail, it should be understood that various changes, substitutions, and alterations can be made hereto without departing from the spirit and scope of the invention as defined by the appended claims.

What is claimed is:

1. A device for automatically adjusting a device containing a clock that derives its timing function from the frequency of an alternating current signal on a power line, comprising:

a module configured to be connected to the device containing a clock, the module further comprising;

a controller operable to receive user-entered controls for adjusting the device containing a clock, the controller being further operable to generate control signals responsive to the user-entered controls;

a frequency changer responsive to the control signals operable to shift the frequency of the alternating current power signal applied to the device containing a clock so that the clock may be adjusted, the frequency changer further comprising:

an AC-to-DC converter for receiving an alternating current signal at a first frequency and providing a direct current signal;

a timing circuit operable to receive the control signals from the controller and further operable to output a timing signal responsive to the control signals; and a DC-to-AC converter coupled to the timing circuit and the AC-to-DC converter operable to convert the direct current signal from the AC-to-DC converter to an alternating current signal at a second frequency responsive to the timing signal from the timing circuit; and a connector coupled to the frequency changer, the connector configured to allow the frequency changer to be coupled to the device containing a clock.

2. The device of claim 1 further comprising a switch coupled to the frequency changer, the switch operable to bypass the frequency changer.

3. The device of claim 1 further comprising a low-pass filter coupled to the AC-to-DC converter and the DC-to-AC converter operable to remove any remaining high-frequency signal components from the direct current signal provided by the AC-to-DC converter.

4. The device of claim 1 further comprising an indicator coupled to the controller for indicating that the device is adjusting the clock.

5. The device of claim 1 further comprising a display coupled to the controller for indicating the amount of time remaining for a clock adjustment.

6. The device of claim 1 wherein the controller further comprises a first function for causing the clock to one of advance and retreat a predetermined time period.

7. The device of claim 6 wherein the controller further comprises a second function for setting the duration for the clock to advance or retreat.

8. The device of claim 1 further comprising a switch coupled to the controller for receiving a user-entered actuation signal.

9. The device of claim 1 further comprising:

a remote controller operable to transmit remote control signals responsive to the user-entered controls; and a detector coupled to the controller, the detector operable to detect the transmitted remote control signals.

10. The device of claim 1 wherein the controller further comprises a remote controller for controlling the device containing a clock, comprising input keys for receiving user-entered input commands, wherein a first input key causes the clock to be advanced a predetermined amount, and a second input key causes the clock to be set-back a predetermined amount.

11. The controller of claim 10 wherein activating one of the input keys causes the clock to advance one hour from its current setting, and wherein activating another of the input keys causes the clock to set-back one hour from its current setting.

12. The controller of claim 10, wherein the controller is operable to be programmed to operate other remotely controlled devices.

13. A device for automatically adjusting a device containing a clock that derives its timing function from the frequency of an alternating current signal on a power line, comprising:

a module configured to be connected to the device containing a clock, the module further comprising;

a controller operable to receive user-entered controls for adjusting the clock, the controller being further operable to generate control signals responsive to the user-entered controls, the controller further comprising a first function for causing the clock to one of advance and retreat a predetermined time period;

a timing circuit operable to receive the control signals from the controller and further operable to output a timing signal responsive to the control signals;

a frequency changer coupled to the controller and responsive to the control signals, the frequency changer operable to shift the frequency of the alternating current signal applied to the clock so that the clock may be adjusted, the frequency changer further comprising;

an AC-to-DC converter for receiving an alternating current signal and providing a direct current power signal;

a low-pass filter coupled to the AC-to-DC converter operable to remove any remaining high-frequency signal components from the direct current power signal; and a DC-to-AC converter coupled to the timing circuit and the low-pass filter operable to convert the direct current signal from the AC-to-DC converter to an alternating current power signal responsive to the timing signal from the timing circuit;

a switch coupled to the AC-to-DC converter, the DC-to-AC converter, and the timing circuit, the switch operable to bypass the frequency changer; and a connector coupled to the frequency changer, the connector configured to allow the frequency changer to be coupled to the device containing a clock.

14. The device of claim 13 wherein the controller further comprises a second function for setting the duration for the clock to advance and retreat.

15. The device of claim 13 further comprising an indicator coupled to the timing circuit for indicating that the frequency changer is adjusting the clock.

16. The device of claim 13 further comprising a display coupled to the timing circuit for indicating the amount of time remaining for a clock adjustment.

17. The device of claim 13 further comprising a remote controller operable to transmit control signals responsive to the user-entered controls.

18. The device of claim 13 further comprising a detector coupled to the timing circuit for receiving controls from the remote controller.

* * * * *